US010798982B2

(12) United States Patent
Ge

(10) Patent No.: US 10,798,982 B2
(45) Date of Patent: Oct. 13, 2020

(54) HAIR EXTENDER

(71) Applicant: Xiang Ge, Bengbu (CN)

(72) Inventor: Xiang Ge, Bengbu (CN)

( * ) Notice: Subject to any disclaimer, the term of this patent is extended or adjusted under 35 U.S.C. 154(b) by 413 days.

(21) Appl. No.: 15/754,586

(22) PCT Filed: Oct. 9, 2016

(86) PCT No.: PCT/CN2016/101564
§ 371 (c)(1),
(2) Date: Feb. 22, 2018

(87) PCT Pub. No.: WO2017/063527
PCT Pub. Date: Apr. 20, 2017

(65) Prior Publication Data

US 2018/0289093 A1 Oct. 11, 2018

(30) Foreign Application Priority Data

Oct. 13, 2015 (CN) ..... 2015 1 0670932

(51) Int. Cl.
*A41G 5/00* (2006.01)
*A45D 44/02* (2006.01)

(52) U.S. Cl.
CPC ..... *A41G 5/0086* (2013.01); *A41G 5/0073* (2013.01); *A45D 44/02* (2013.01)

(58) Field of Classification Search
CPC .. A41G 5/0086; A41G 5/0053; A41G 5/0066; A41G 5/00; A41G 5/006;
(Continued)

(56) References Cited

U.S. PATENT DOCUMENTS 1,606,734 A * 11/1926 Charles ..... A45D 2/44 132/136
5,305,767 A * 4/1994 Ivanov ..... A45D 24/36 132/144

(Continued)

FOREIGN PATENT DOCUMENTS

CN 1968619 5/2007
CN 201782237 4/2011

(Continued)

OTHER PUBLICATIONS

The State Intellectual Property Office of People's Republic of China, First Office Action issued in connection with Chinese Application No. 201510670932.1, with English translation, dated Sep. 21, 2017, 7 pages.

(Continued)

*Primary Examiner* — Tatiana L Nobrega
*Assistant Examiner* — Samuel A Raque
(74) *Attorney, Agent, or Firm* — Hanley, Flight & Zimmerman, LLC

(57) ABSTRACT

The present disclosure provides a hair extender. The hair extender comprises a main plate, a clamping assembly, and a transmission pressing plate; the main plate is provided with a sliding groove, a plurality of first clamping bosses extended forwards from a bottom of the sliding groove, first clamping recesses being provided on right sidewalls of the first clamping bosses, and a plurality of mounting grooves being provided on the bottom of the sliding groove; the clamping assembly is mounted in the sliding groove of the main plate, a plurality of second clamping bosses extended forwards from a push rod of the clamping assembly, second clamping recesses being provided on sidewalls of the second clamping bosses, and a reset spring of the clamping assembly abutting between a right portion of the sliding groove and the push rod; the main plate is provided with a moving (Continued)

groove, the transmission pressing plate being mounted in the moving groove, and a plurality of mounting rods being fixed under an extension portion of the transmission pressing plate. A fixing pin of a hair extension clip is disconnected from a C-shaped buckle, the fixing pin is fitted with the mounting rod of the transmission pressing plate, the C-shaped buckle is placed in a clamping cavity, real hair is placed in the C-shaped buckle of the hair extension clip, and the transmission pressing plate is driven to move downwards, until the fixing pin completely enters the C-shaped buckle, thereby fixing the real hair in the hair extension clip.

6 Claims, 15 Drawing Sheets

(58) Field of Classification Search
CPC ..... A45D 2007/002; A45D 2007/004; A45D 2/38; A45D 2/40; A45D 2024/345; A45D 1/08; B65B 13/34; A63H 3/44
USPC ..... 132/201, 53, 212, 333, 144, 145
See application file for complete search history.

(56) References Cited

U.S. PATENT DOCUMENTS

| | | | | |
|---|---|---|---|---|
| 6,279,303 | B2 * | 8/2001 | Sloan | A01K 13/00 54/1 |
| 8,839,521 | B2 | 9/2014 | Hazard | |
| 9,974,565 | B2 * | 5/2018 | Oostman, Jr. | A61B 17/3468 |
| 2004/0001372 | A1 | 1/2004 | Higo et al. | |
| 2004/0103910 | A1 * | 6/2004 | Ott | B29C 66/69 132/201 |
| 2005/0236007 | A1 * | 10/2005 | Tokko | A41G 5/0066 132/201 |
| 2005/0247326 | A1 | 11/2005 | Park | |
| 2011/0146698 | A1 * | 6/2011 | Guliker | B29C 66/21 132/201 |
| 2012/0080047 | A1 * | 4/2012 | Glucksman | A45D 20/48 132/223 |
| 2013/0284922 | A1 | 10/2013 | Mikami et al. | |
| 2015/0313303 | A1 * | 11/2015 | Harris | A41G 5/0066 132/201 |
| 2016/0050997 | A1 * | 2/2016 | Ott | A41G 5/008 132/148 |
| 2016/0128409 | A1 * | 5/2016 | Ott | A41G 5/0086 132/53 |

FOREIGN PATENT DOCUMENTS

| | | | | |
|---|---|---|---|---|
| CN | 103315511 | | 9/2013 | |
| CN | 104522985 | | 4/2015 | |
| CN | 105146899 | | 12/2015 | |
| CN | 205053176 | | 3/2016 | |
| DE | 202011101952 | U1 * | 9/2011 | |
| DE | 202011101952 | U1 * | 10/2011 | A41G 5/006 |
| JP | 2012-138316 | | 7/2012 | |
| KR | 20-0474318 | | 9/2014 | |
| WO | 2007140543 | | 12/2007 | |
| WO | WO-2010144975 | A1 * | 12/2010 | |
| WO | WO-2014086491 | A1 * | 6/2014 | |

OTHER PUBLICATIONS

The State Intellectual Property Office of People's Republic of China, Search Report issued in connection with Chinese Application No. 201510670932.1, with English translation, dated Sep. 21, 2017, 2 pages.

International Searching Authority, International Search Report, issued in connection with International Application No. PCT/CN2016/101564, dated Dec. 29, 2016, 3 pages.

* cited by examiner

HAIR EXTENDER

RELATED APPLICATION

This patent arises from an application that is National Stage Application of International Application No. PCT/CN2016/101564, filed on Oct. 9, 2016, which is hereby incorporated by reference in its entirety. Further, this patent claims priority to Chinese Patent Application 201510670932.1, filed on Oct. 13, 2015, which is hereby incorporated by reference in its entirety.

TECHNICAL FIELD

The present disclosure relates to a hair extender.

BACKGROUND

Hair extension is to extend hair to real hair of a user, so as to achieve an instantaneous change from short hair into long hair. Currently, the manner of hair extension is gluing or stringing. The hair extension by gluing is that a hairdresser applies glue on real hair, and then bonds wig with a little of real hair. The hair extension by stringing is that a hairdresser manually twines the wig on a little of real hair. However, the above manner of gluing or stringing relies on the hairdresser's manual operation. Thus, the workload is large, the time and energy is wasted, and the fixing effect is poor. There is in the market no special tool for performing the above operation in batches.

SUMMARY

The technical problem to be solved by the present disclosure is to provide a hair extender which is easy to be used with a good hair extension effect.

In order to solve the technical problem, the present disclosure provides a hair extender, at least comprising a main plate, a clamping assembly, and a transmission pressing plate, wherein a rear surface of the main plate is provided with a sliding groove running distal and proximal; a plurality of first clamping bosses are extended forwards from a bottom of the sliding groove to go beyond a front surface of the main plate, distributed at an interval, and arranged in a straight line; a right sidewall of each of the first clamping bosses is provided with a first clamping recess; the bottom the bottom of the sliding groove is provided with a plurality of mounting grooves running through the front surface and rear surface of the main plate, and the mounting grooves are one-to-one corresponding to the first clamping bosses;

the clamping assembly is mounted in the sliding groove of the main plate, and comprises a push rod and a reset spring; a plurality of second clamping bosses are extended forwards from positions on the push rod corresponding to the mounting grooves of the main plate; the second clamping bosses run through the mounting grooves and are one-to-one corresponding to the first clamping bosses; a second clamping recess is provided at a position on a sidewall of each of the second clamping bosses corresponding to one of the first clamping recesses of the first clamping bosses; one of the first clamping recesses and one of the second clamping recesses together construct a clamping cavity matched with a hair extension clip; a proximal end of the reset spring abuts the fixture block, and a distal end of the reset spring abuts against a proximal end of the push rod;

the main plate is provided with a moving groove running upwards and downwards; the transmission pressing plate is mounted in the moving groove; an extension portion is extended from the transmission pressing plate towards an upper side of the main plate; a plurality of vertical mounting rods are fixed below the extension portion, located above the sliding groove of the main plate, and one-to-one corresponding to the clamping cavities.

After the above structure is adopted, a fixing pin of a hair extension clip is disconnected from a C-shaped buckle, and the wig is fixed on the C-shaped buckle; the fixing pin is fitted with the mounting rod of the transmission pressing plate, the C-shaped buckle is placed in a clamping cavity, real hair is placed in the C-shaped buckle of the hair extension clip, and the transmission pressing plate is driven to move downwards, until the fixing pin completely enters the C-shaped buckle, thereby fixing the real hair in the hair extension clip.

In the hair extender, a front side of the main plate is fixed to a buckle plate, which is provided with a through-hole matched with the first clamping bosses and the second clamping bosses; the first clamping bosses of the main plate and the second clamping bosses of the push rod run through the through-hole and protrude from a front side of the buckle plate; a plurality of first limiting bosses are extended forwards from a front buckle surface and located above the through-hole; a right sidewall of each of the first limiting bosses is provided with a first limiting recess; the first limiting recesses are one-to-one corresponding to the first clamping recesses of the first clamping bosses; a projection of a sidewall of each of the first limiting recesses onto a horizontal plane is located at a right side of a projection of corresponding one of the first clamping recesses onto the horizontal plane;

a plurality of second limiting bosses are extended forwards from the front buckle surface and located under the through-hole; a right sidewall of each of the second limiting bosses is provided with a second limiting recess; the second limiting recesses are also one-to-one corresponding to the first clamping recesses of the first clamping bosses; a projection of a sidewall of each of the second limiting recesses onto a horizontal plane is located at a right side of a projection of corresponding one of the first clamping recesses onto the horizontal plane.

After the above structure is adopted, the assembly and disassembly between the C-shaped buckle and the fixing pin can be directly completed by the hair extender. When it is necessary to disconnect the C-shaped buckle and the fixing pin from each other, the first limiting boss can limit the movement of the C-shaped buckle relative to the fixing pin. When the fixing pin is to be loaded into the C-shaped buckle, the second limiting boss can also limit the movement of the C-shaped buckle relative to the fixing pin.

The hair extender can perform the hair extension operation in batches, thereby reducing the hairdresser's repetitive works and improving the hair extension efficiency.

In the hair extender, a chamfer is formed between a terminal end and a right side surface of each of the first clamping bosses, a chamfer is formed between a terminal end and a left side surface of each of the second clamping bosses, a chamfer is formed between a terminal end and a right side surface of each of the first limiting bosses, and a chamfer is formed between a terminal end and a right side surface of each of the second limiting bosses. After the above structure is adopted, the real hair can be conveniently placed into the C-shaped buckle.

In the hair extender, a lower side of the main plate is hinged with a handle; a middle portion of the handle is hinged with a lower portion of the main plate, and a left portion of the handle is hinged with a lower end of the transmission pressing plate. After the above structure is adopted, the operation is convenient.

The hair extender further comprises a hair fixing assembly; the main plate is provided with a fixed sliding groove running distal and proximal; a middle portion of the fixed sliding groove is located above the first clamping boss, and exposed outside the main plate; the fixed sliding groove is communicated with the moving groove of the main plate, and the hair fixing assembly is placed in the fixed sliding groove;

a rear end surface of the transmission pressing plate is provided with a sliding block, chamber being formed between left and right sidewalls and a bottom block surface of the sliding block, respectively; the transmission pressing plate is mounted in the moving groove of the main plate;

the hair fixing assembly comprises a shaft lever, a first fixing block, a second fixing block, a hair fixing spring, and a moving block; the first fixing block, the hair fixing spring, the moving block, and the second fixing block are orderly mounted on the shaft lever from left to right; the first fixing block and the second fixing block are fixed to the shaft lever, respectively; the moving block and the second fixing block are provided with a displacement bulge, respectively; the displacement bulge of the moving block and the displacement bulge of the second fixing block protrude into the moving groove and are fitted with left and right end surfaces of the sliding block of the transmission pressing plate, respectively.

After the above structure is adopted, it can be ensured that the hair fixing assembly can fix the real hair when the fixing pin of the hair extension clip enters the C-shaped buckle, thereby preventing the fixing pin from dragging the real hair and avoiding the user's hair being damaged.

In the hair extender, the sliding groove of the main plate passes the moving groove;

a rear surface of the sliding block of the transmission pressing plate is provided with a elongated hole having a lengthwise direction consistent with a running direction of a left sidewall of the sliding block;

a counter bore is provided at a position on a front end surface of the push rod corresponding to the elongated hole of the transmission pressing plate; the push rod is further provided with a reutilization assembly comprising a reutilization spring and a connection rod that is fitted with the counter bore of the push rod; a front end and a rear end of the connection rod are provided with a convex ring, respectively; the reutilization spring is mounted over the connection rod, a front end of the reutilization spring abutting against a rear end surface of the push rod, and a rear end of the reutilization spring abutting against the convex ring at a rear end of the connection rod.

Once the hair extension clip is used, the C-shaped buckle will be deformed, and the rabbet of the C-shaped buckle will be expanded. Nevertheless, after the above structure is adopted, the position of the push rod can be controlled to expand the space of the clamping cavity, which allows the deformed C-shaped buckle to be received, so that the hair extension clip can be used repeatedly, and the use cost can be reduced.

DETAILED DESCRIPTION OF THE PREFERRED EMBODIMENTS

Figure 1:
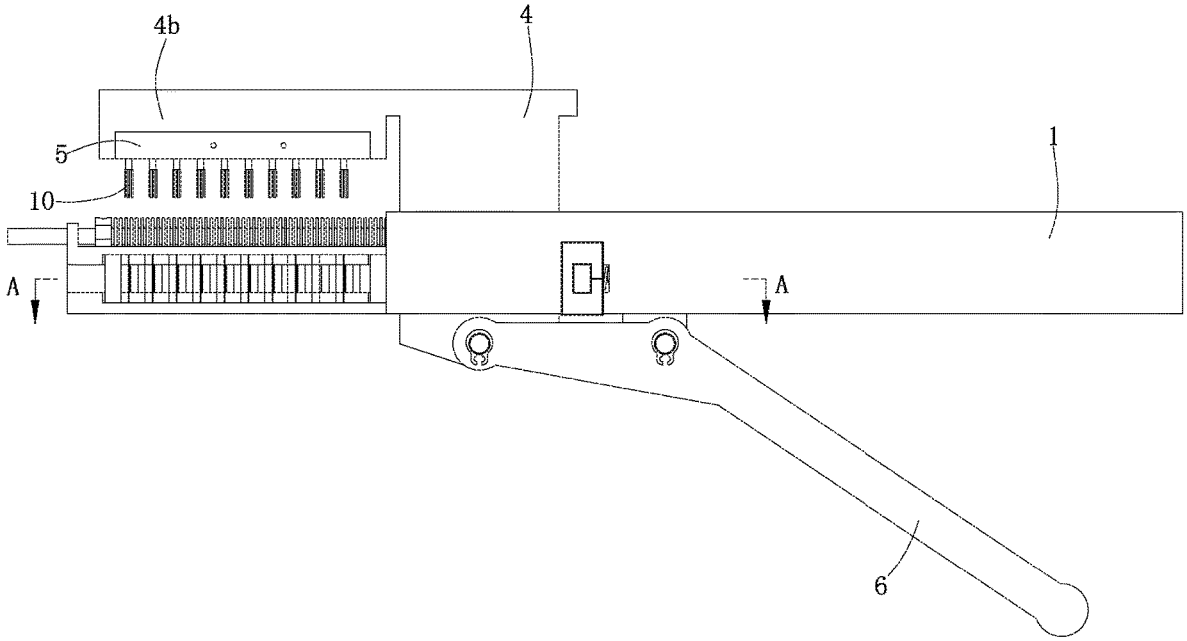
FIG. 1 is a front view of an example of a hair extender of the present disclosure.
Figure 2:
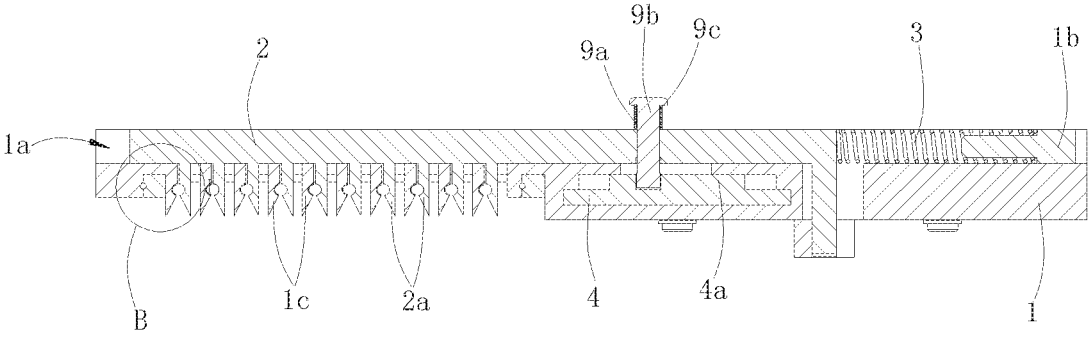
FIG. 2 is a sectional view along direction A-A in FIG. 1.
Figure 3:
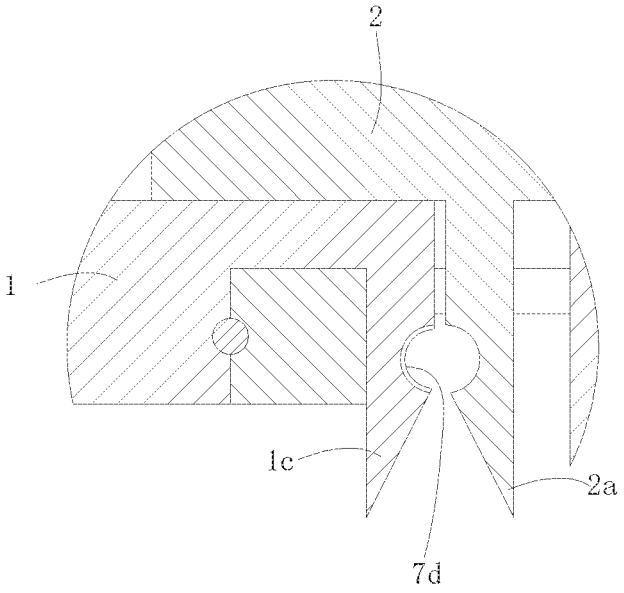
FIG. 3 is an enlarged view of portion B in FIG. 2.
Figure 4:
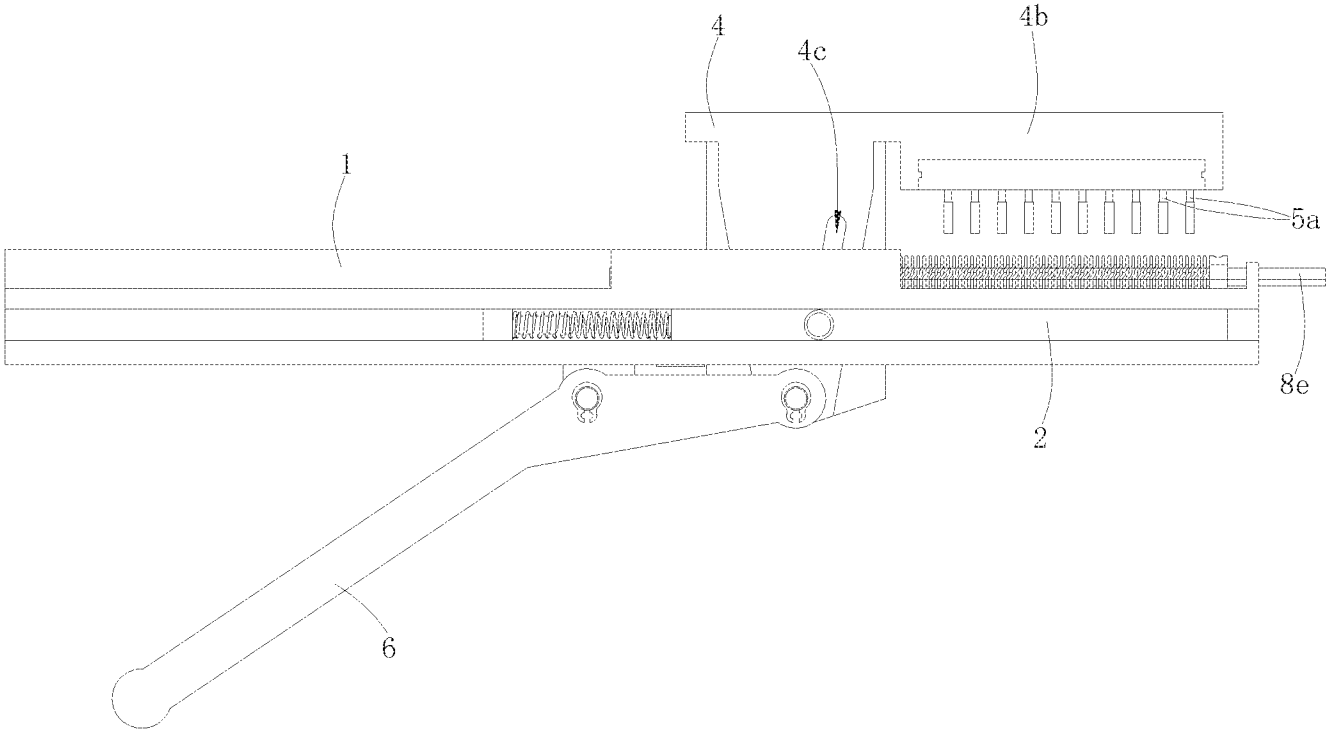
FIG. 4 is a back view of an example of a hair extender of the present disclosure.
Figure 5:
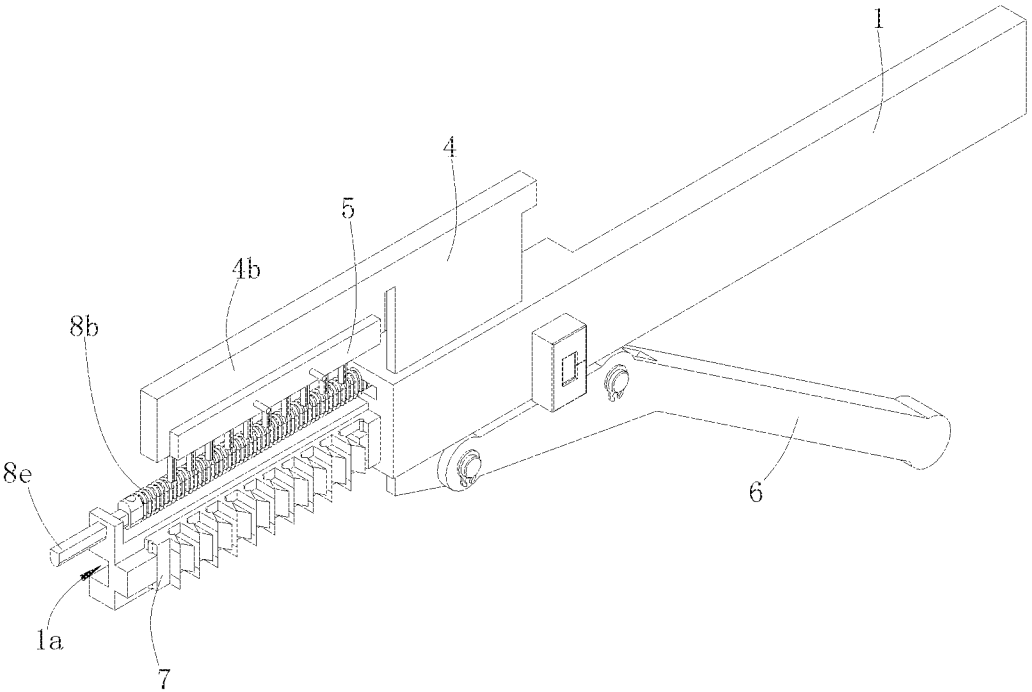
FIG. 5 is a perspective view of an example of a hair extender of the present disclosure.
Figure 6:
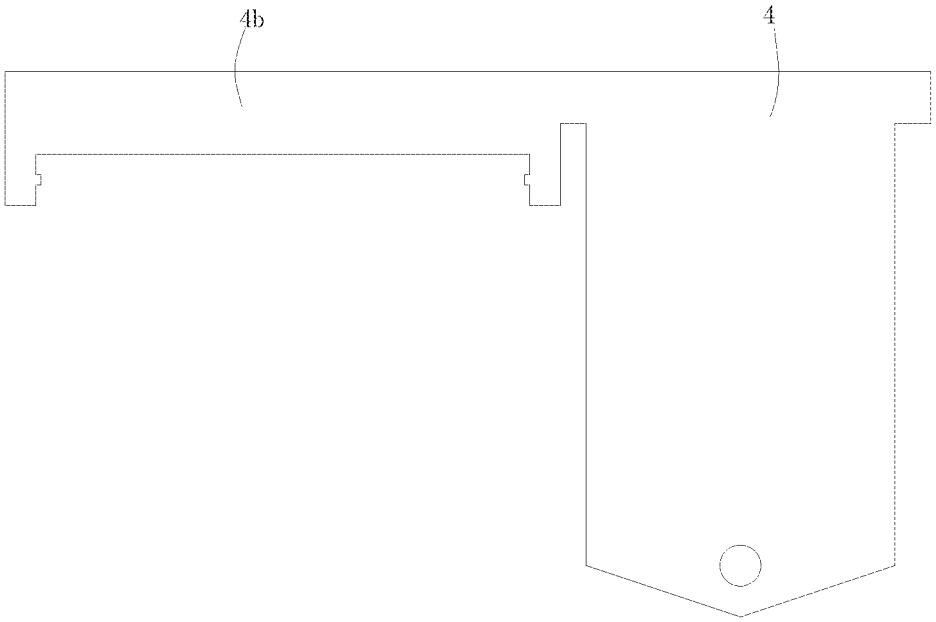
FIG. 6 is a front view of a transmission plate body of an example of a hair extender of the present disclosure.
Figure 7:
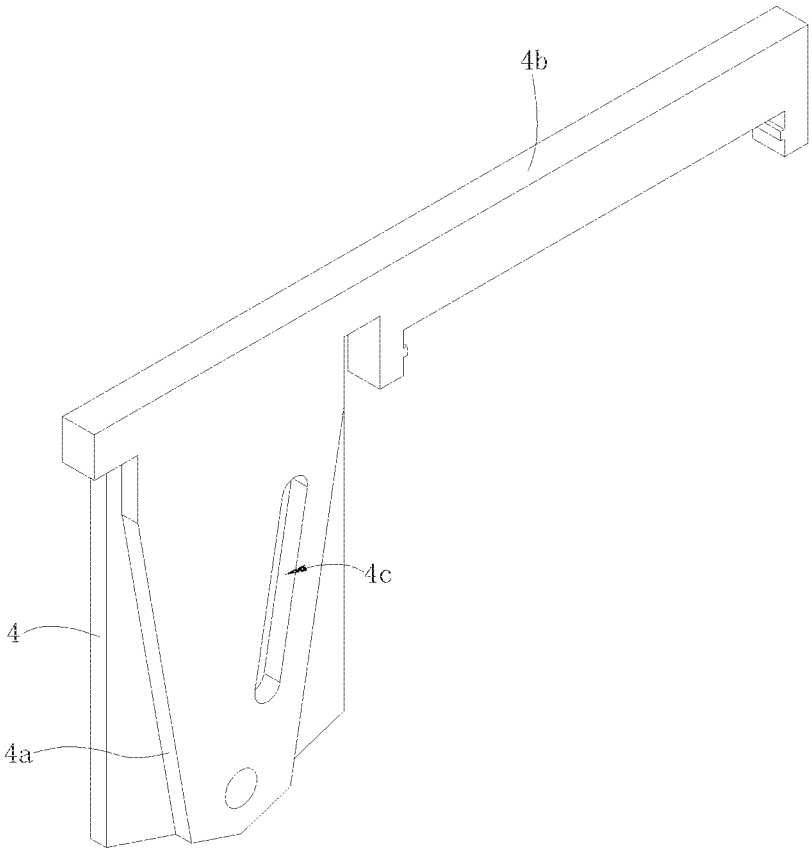
FIG. 7 is a perspective view of a transmission plate body of an example of a hair extender of the present disclosure.
Figure 8:
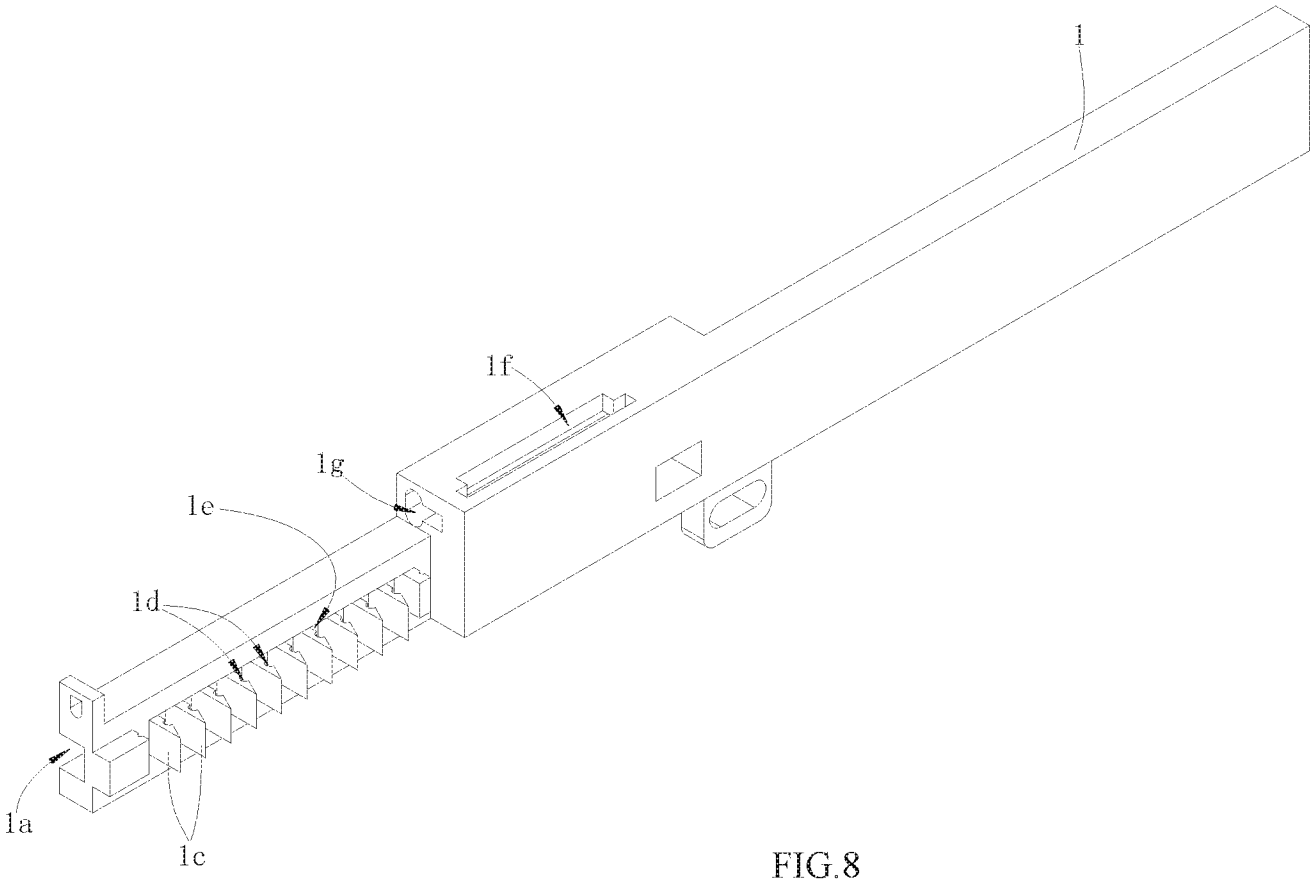
FIG. 8 is a perspective view of a main plate of an example of a hair extender of the present disclosure.
Figure 9:
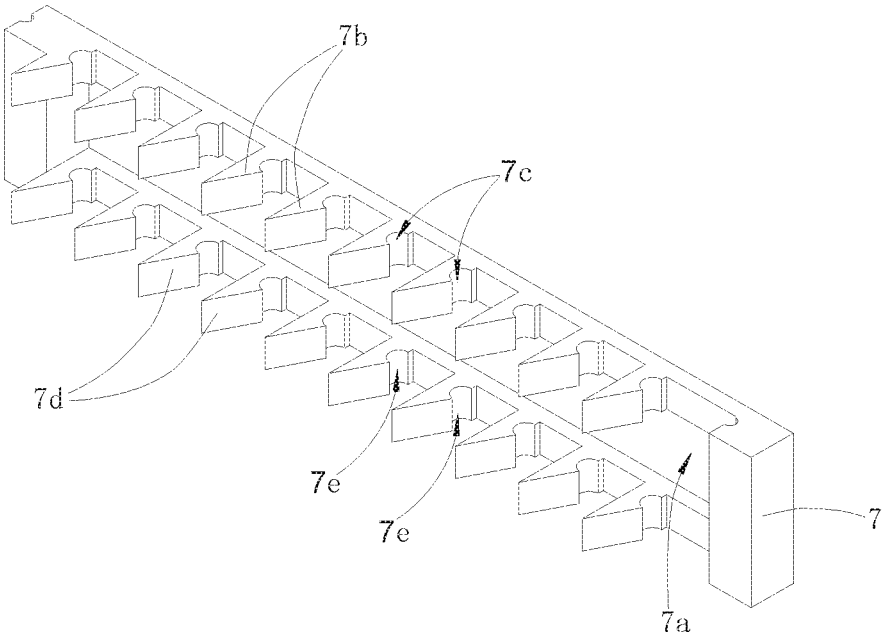
FIG. 9 is a perspective view of a buckle plate of an example of a hair extender of the present disclosure.
Figure 10:
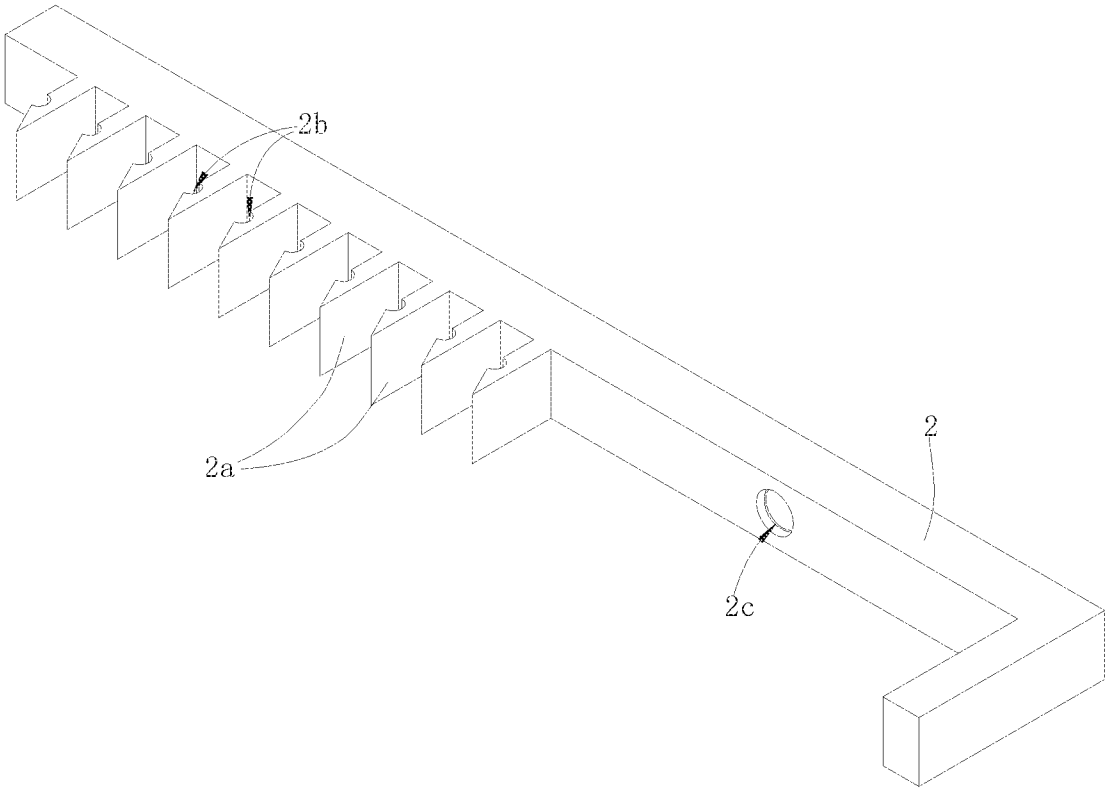
FIG. 10 is a perspective view of a push rod of an example of a hair extender of the present disclosure.
Figure 11:
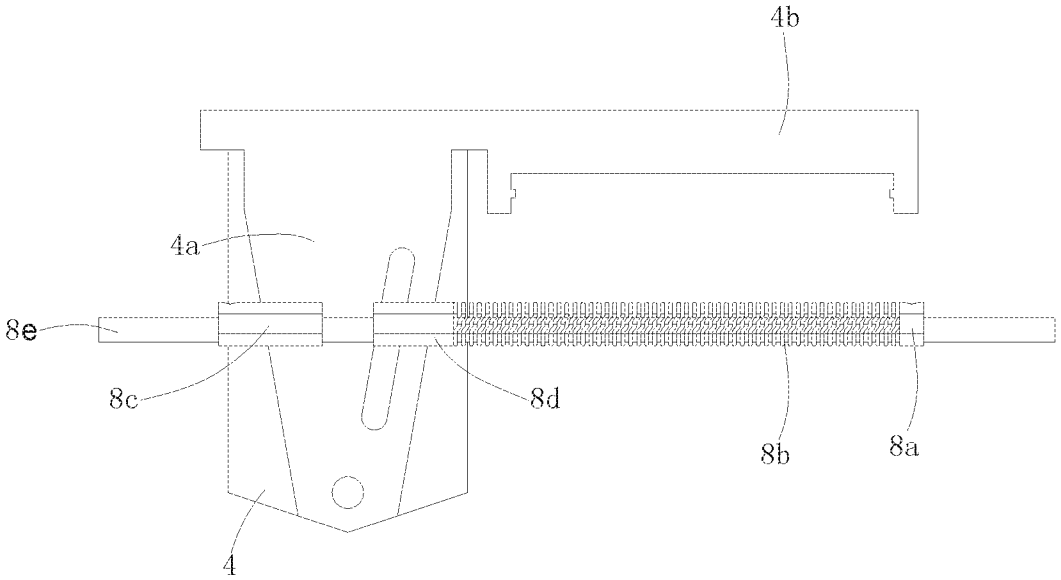
FIG. 11 is a back view of a transmission plate body and a hair fixing assembly of an example of a hair extender of the present disclosure.
Figure 12:
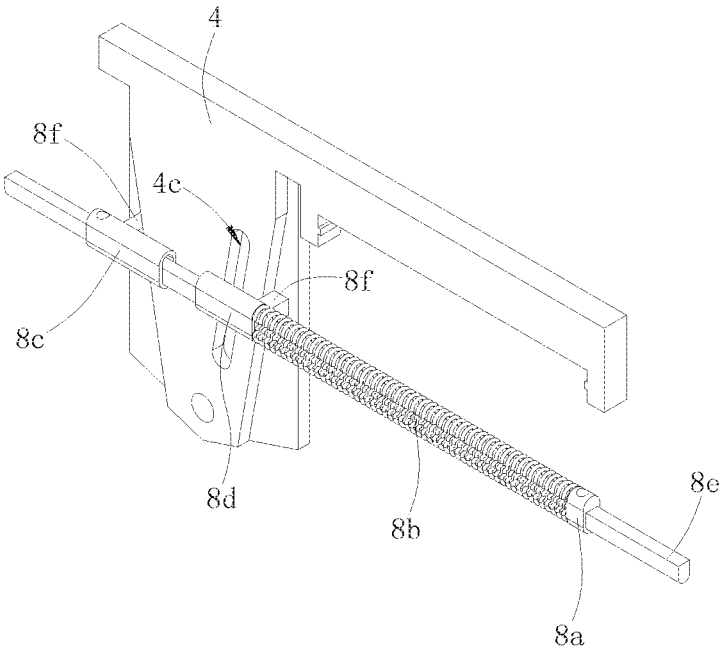
FIG. 12 is a perspective view of FIG. 11.
Figure 13:
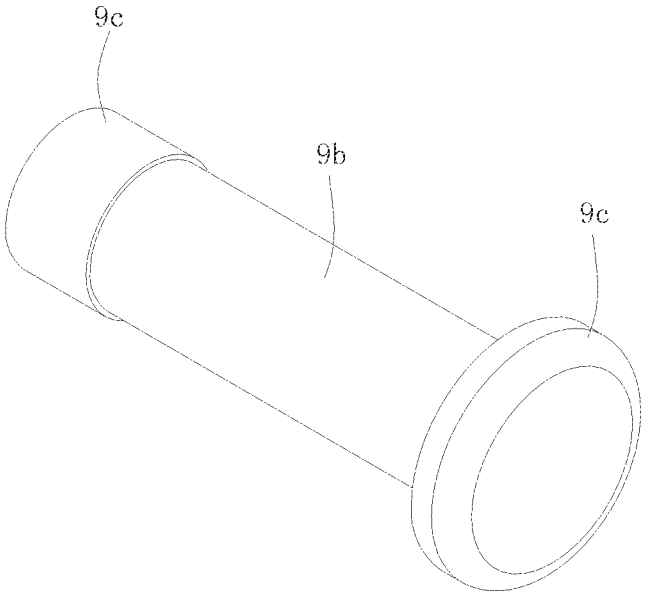
FIG. 13 is a perspective view of a connection rod of an example of a hair extender of the present disclosure.

Refer to FIGS. 1 to 13.

A hair extender comprises a main plate 1, a clamping assembly, a transmission pressing plate, a buckle plate 7, a handle 6, a hair fixing assembly, and a reutilization assembly.

A lower portion of a rear surface of the main plate 1 is provided with a sliding groove 1*a* running distal and proximal. A fixture block 1*b* is placed at a right portion of the sliding groove 1*a*. Ten first clamping bosses 1*c* are extended from a bottom of the sliding groove 1*a* to go beyond a front surface of the main plate 1, distributed at an interval, and arranged in a straight line. A chamfer is formed between a terminal end and a right side surface of the first clamping boss 1*c*. A right sidewall of the first clamping boss 1*c* is provided with a first clamping recess 1*d*. The bottom of the sliding groove 1*a* is provided with ten mounting grooves 1*e* running through the front end surface and the rear end surface of the main plate 1. The mounting grooves 1*e* are one-to-one corresponding to the first clamping bosses 1*c*, and each of the mounting grooves 1*e* is located at a right side of the corresponding first clamping boss 1*c*.

The main plate 1 is provided with a moving groove 1*f* running upwards and downwards, and the sliding groove 1*a* of the main plate 1 passes the moving groove 1*f*.

The main plate 1 is provided therein with a fixed sliding groove 1*g* running distal and proximal. A middle portion of the fixed sliding groove 1*g* is located above the first clamping boss 1*c*, and exposed outside the main plate 1 in correspondence with the ten first clamping bosses 1*c*. The fixed sliding groove 1*g* is communicated with the moving groove 1*f* of the main plate 1.

The clamping assembly is mounted in the sliding groove 1*a* of the main plate 1, and comprises a push rod 2 and a reset spring 3. Ten second clamping bosses 2*a* are extended forwards from positions on the push rod 2 corresponding to the mounting grooves 1*e* of the main plate 1, run through the mounting grooves 1*e*, and are one-to-one corresponding to the first clamping bosses 1*c*. A chamfer is formed between a terminal end and a left side surface of the second clamping boss 2*a*. A second clamping recess 2*b* is provided at a position on a sidewall of each of the second clamping boss 2*a* corresponding to the first clamping recess 1*d* of one of the first clamping bosses 1*c*. The reset spring 3 is provided in the sliding groove 1*a*, a right end of the reset spring 3 abuts against a fixture block 1*b* of a right portion of the sliding groove 1*a*, a left end of the reset spring 3 abuts against a right end portion of the push rod 2. The reset spring 3 acts on the push rod 2 so that the second clamping boss 2*a* abuts against the first clamping boss 1*c* to maintain a balance of the push rod 2. The second clamping bosses 2*a* may be in a reciprocating motion distal and proximal in the mounting grooves 1*e* and one of the first clamping recesses 1*d* and one of the second clamping recesses 2*b* together construct a clamping cavity matched with the hair extension clip.

The transmission pressing plate is mounted in the moving groove 1*f*, and comprises a transmission plate body 4 and a pressing plate body 5. A rear end surface of the transmission plate body 4 is provided with a sliding block 4*a*. Chambers are formed between left and right sidewalls of the sliding block 4*a* and a bottom block surface of the sliding block 4*a*, respectively. The transmission plate body 4 is fitted with the moving groove 1*f* of the main plate 1 and provided with an extension portion 4*b* extending towards an upper left side of the main plate 1. The pressing plate body 5 is mounted under the extension portion 4*b* of the transmission plate body 4. Ten vertical mounting rods 5*a* are extended from a lower side of the pressing plate body 5, located above the sliding groove 1*a* of the main plate 1, and one-to-one corresponding to the clamping cavities.

A rear surface of the sliding block 4*a* of the transmission plate body 4 is provided with a elongated hole 4*c* having a lengthwise direction consistent with a running direction of a left sidewall of the sliding block 4*a*.

A lower side of the main plate 1 is hinged with a handle 6, a middle portion of the handle 6 is hinged with a lower portion of the main plate 1, and a left portion of the handle 6 is hinged with a lower end of the transmission plate body 4 of the transmission pressing plate.

A front side of the main plate 1 is fixed with a buckle plate 7, which is provided with a through-hole 7*a* matched with the first clamping bosses 1*c* and the second clamping bosses 2*a*. The first clamping boss 1*c* of the main plate 1 and the second clamping boss 2*a* of the push rod 2 run through the through-hole 7*a* and protrude from a front side of the buckle plate 7. Ten first limiting bosses 7*b* are extended forwards from a of the buckle surface and located above the through-hole 7*a*, a chamfer being formed between a terminal end and a right side surface of the first limiting boss 7*b*. Right sidewalls of the first limiting bosses 7*b* are provided with first limiting recesses 7*c* one-to-one corresponding to the first clamping recesses 1*d* of the first clamping boss 1*c*. A projection of a sidewall of the first limiting recess 7*c* onto a horizontal plane is located at a right side of a projection of corresponding first clamping recess 1*d* onto the horizontal plane, i.e., a projection position of the first limiting recess 7*c* on the horizontal plane is slightly more right than a projection position of corresponding first clamping recess 1*d* on the horizontal plane.

Ten second limiting bosses 7*d* are extended forwards from a buckle surface and located under the through-hole 7*a*, a chamfer being formed between a terminal end and a right side surface of the second limiting boss 7*d*. Right sidewalls of the second limiting bosses 7*d* are provided with second limiting recesses 7*e* also one-to-one corresponding to the first clamping recesses 1*d* of the first clamping bosses 1*c*. A projection of a sidewall of the second limiting recess 7*e* onto a horizontal plane is located at a right side of a projection of corresponding first clamping recess 1*d* onto the horizontal plane, i.e., a projection position of the second limiting recess 7*e* on the horizontal plane is also slightly more right than a projection position of corresponding first clamping recess 1*d* on the horizontal plane.

The hair fixing assembly is placed in the fixed sliding groove 1*g*, and comprises a shaft lever 8*e*, a first fixing block 8*a*, a second fixing block 8*c*, a hair fixing spring 8*b*, and a moving block 8*d*. The first fixing block 8*a*, the hair fixing spring 8*b*, the moving block 8*d*, and the second fixing block 8*c* are orderly mounted on the shaft lever 8*e* from left to right. The first fixing block 8*a* and the second fixing block 8*c* are fixed to the shaft lever 8*e*, respectively. Each of the moving block 8*d* and the second fixing block 8*c* is provided with a displacement bulge 8*f*. The displacement bulges 8*f* of the moving block 8*d* and the second fixing block 8*c* protrude into the moving groove 1*f* and fitted with left and right end surfaces of the sliding block 4*a* of the transmission pressing plate, respectively.

A front end surface of the push rod 2 is provided with a counter bore 2*c* corresponding to the elongated hole 4*c* of the transmission pressing plate. The push rod 2 is further provided with a reutilization assembly comprising a reutilization spring 9*a* and a connection rod 9*b*. The connection rod 9*b* is fitted with the counter bore 2*c* of the push rod 2, and a front end and a rear end of the connection rod 9*b* are provided with a convex ring 9*c*. The reutilization spring 9*a* is mounted over the connection rod 9*b*, a front end of the reutilization spring 9*a* abuts against a rear end surface of the push rod 2, and a rear end of the reutilization spring 9*a* abuts against the convex ring 9*c* at a rear end of the connection rod 9*b*.

Figure 14:
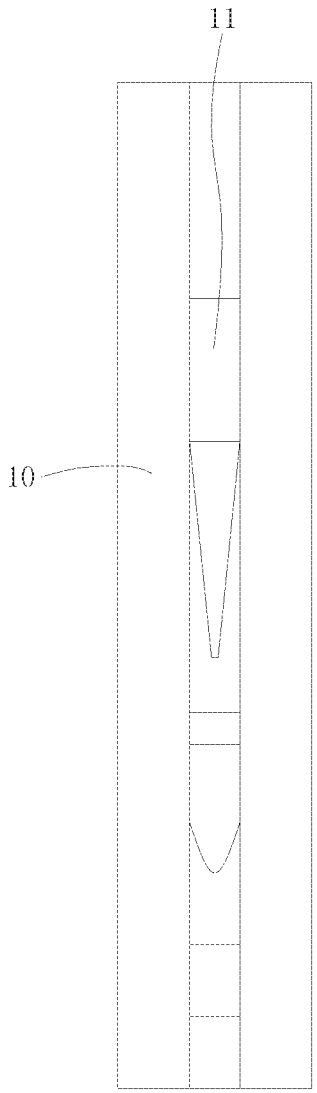
FIG. 14 is a front view of a hair extension clip of an example of a hair extender of the present disclosure.
Figure 15:
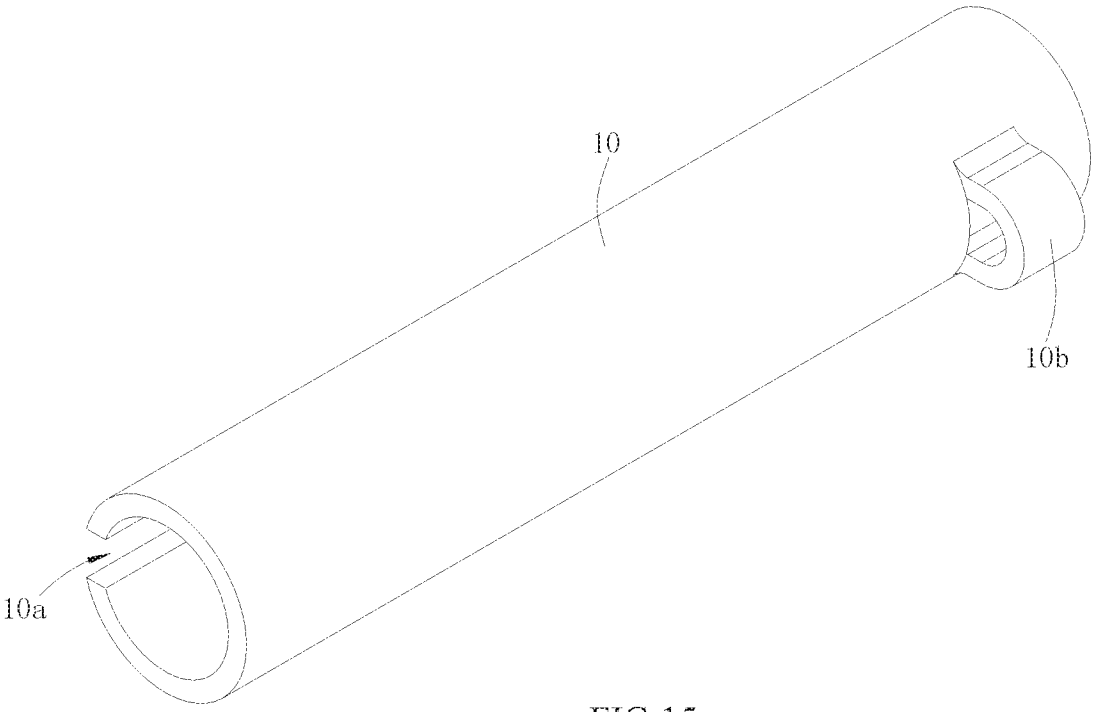
FIG. 15 is a perspective view of a C-shaped buckle of an example of a hair extender of the present disclosure.
Figure 16:
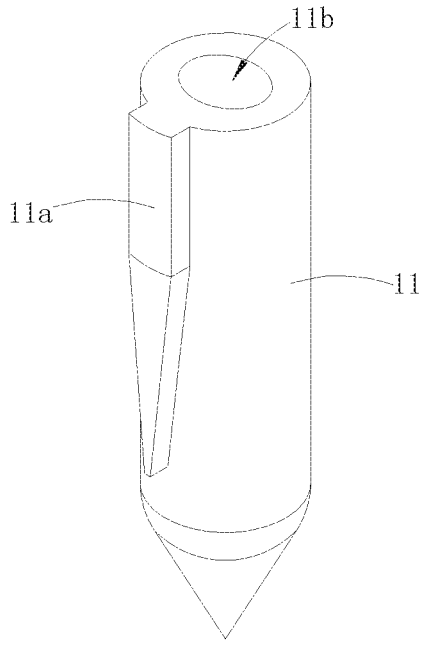
FIG. 16 is a perspective view of a fixing pin of an example of a hair extender of the present disclosure.

Refer to FIGS. 14 to 16.

In order to better understand the working principle of the hair extender, a structure of a hair extension clip is introduced herein.

The hair extension clip comprises a C-shaped buckle 10 and a fixing pin 11. An outer wall of the C-shaped buckle 10 is provided with a rabbet 10*a* communicated with an inner hole, and a fixing ring 10*b* is extended from a lower end of the C-shaped buckle 10, wig being connected to the fixing ring 10*b*. The fixing pin 11 is fitted with the inner hole of the C-shaped buckle 10, an upper sidewall of the fixing pin 11 is provided with a limiting bulge 11*a* fitted with the rabbet 10*a* of the C-shaped buckle 10, and an upper end surface of the fixing pin 11 is provided with an assembly hole 11*b* matched with the mounting rod 5*a* of the transmission pressing plate.

During usage, ten hair extension clips are mounted on the ten mounting rods 5*a* of the transmission pressing plate, respectively, and each of the mounting rod 5*a* is fitted with the fixing pin 11 of each of the hair extension clip.

The handle 6 is operated to drive the transmission plate body 4 of the transmission pressing plate to move downwards, so that the hair extension clip fixed on the pressing plate body 5 is driven to move downwards, and the C-shaped buckle 10 of the hair extension clip contacts the first limiting boss 7*b* of the buckle plate 7. Since the projection position of the first limiting recess 7*c* on the horizontal plane is slightly more right than the projection position of corresponding first clamping recess 1*d* on the horizontal plane, the mounting rod 5*a* is inclined proximal to drive the whole hair extension clip to deviate proximal by a small displacement and enter a clamping cavity formed by the first clamping boss 1*c* of the main plate 1 and the second clamping boss 2*a* of the push rod 2, until the C-shaped buckle 10 of the hair extension clip fully enters the clamping cavity, and then the mounting rod 5*a* returns to the initial vertical state under a stress of itself.

The handle 6 is released so as to move the sliding block 4*a* of the transmission plate body 4 upwards under the action of the hair fixing assembly, so that the hair extension clip is driven to move upwards, and the C-shaped buckle 10 of the hair extension clip abuts against a lower end surface of the first limiting boss 7*b*, and cannot move upwards along with the pressing plate body 5, so that the C-shaped buckle 10 of the hair extension clip is separated from the fixing pin 11.

Next, real hair is placed in the C-shaped buckle 10 of the hair extension clip. The handle 6 is operated again to drive the transmission plate body 4 of the transmission pressing plate to move downwards; the hair fixing assembly is fitted with the sliding block 4*a* of the transmission plate body 4; the displacement bulge 8*f* of the moving block 8*d* and the displacement bulge 8*f* of the second fixing block 8*c* move on the left and right sidewalls of the sliding block 4*a*, respectively; since the chamfers are formed between the bottom block surface and the left and right end surfaces of the sliding block 4*a*, respectively, the distance between the moving block 8*d* and the second fixing block 8*c* is increasingly larger; the hair fixing spring 8*b* of the hair fixing assembly is extruded by the moving block 8*d*; the hair fixing spring 8*b* clamps the real hair placed in the C-shaped buckle 10; meanwhile, the mounting rod 5*a* of the transmission pressing plate drives the fixing pin 11 of the hair extension clip to move downwards; a lower end surface of the C-shaped buckle 10 abuts against an upper end surface of the second limiting boss 7*d* to ensure that the C-shaped buckle 10 does not move along with the fixing pin 11, until the fixing pin 11 fully enters the C-shaped buckle 10, thereby completing the hair extension operation.

In addition, if the hair extension clip used in the hair extension operation is a reutilized hair extension clip, the opening angle of the C-shaped buckle 10 will be too large. Under normal circumstances, it is difficult for the C-shaped buckle 10 having too large an opening angle to be tightly fitted with the fixing pin 11 again. In that case, the connection rod 9*b* of the reutilization assembly is pressed down, so that the connection rod 9*b* runs through the push rod 2 and enters the waist-shaped hole 4*c* of the sliding block 4*a*; at the same time of the above normal hair extension operation, the push rod 2 moves distal under the action of the sliding block 4*a*, i.e., the second clamping recess 2*b* of the push rod 2 moves distal to urge the C-shaped buckle 10 in the clamping cavity to be deformed by force and recovered into a state fitted with the fixing pin 11, so as to complete the reutilization of the hair extension clip.

Figure 17:
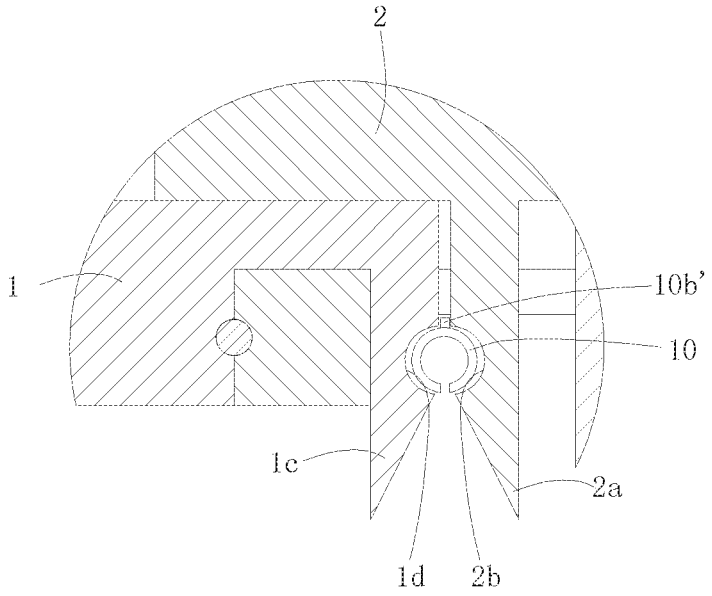
FIG. 17 is a structure view of an engagement between a C-shaped buckle, a first clamping boss and a second clamping boss of an example of a hair extender of the present disclosure.

As illustrated in FIG. 17, when the C-shaped buckle of the hair extension clip is interposed between the first clamping recess 1*d* of the first clamping boss 1*c* of the main plate 1 and the second clamping recess 2*b* of the second clamping boss 2*a* of the push rod 2, the rabbet 10*a* of the C-shaped buckle faces the chamfer of the first clamping boss 1*c* and the chamfer of the second clamping boss 2*a*, i.e., the rabbet 10*a* of the C-shaped buckle faces the front side of the hair extender, while the fixing ring 10*b* on the C-shaped buckle is interposed between the first clamping boss 1*c* and the second clamping boss 2*a*.

Figure 18:
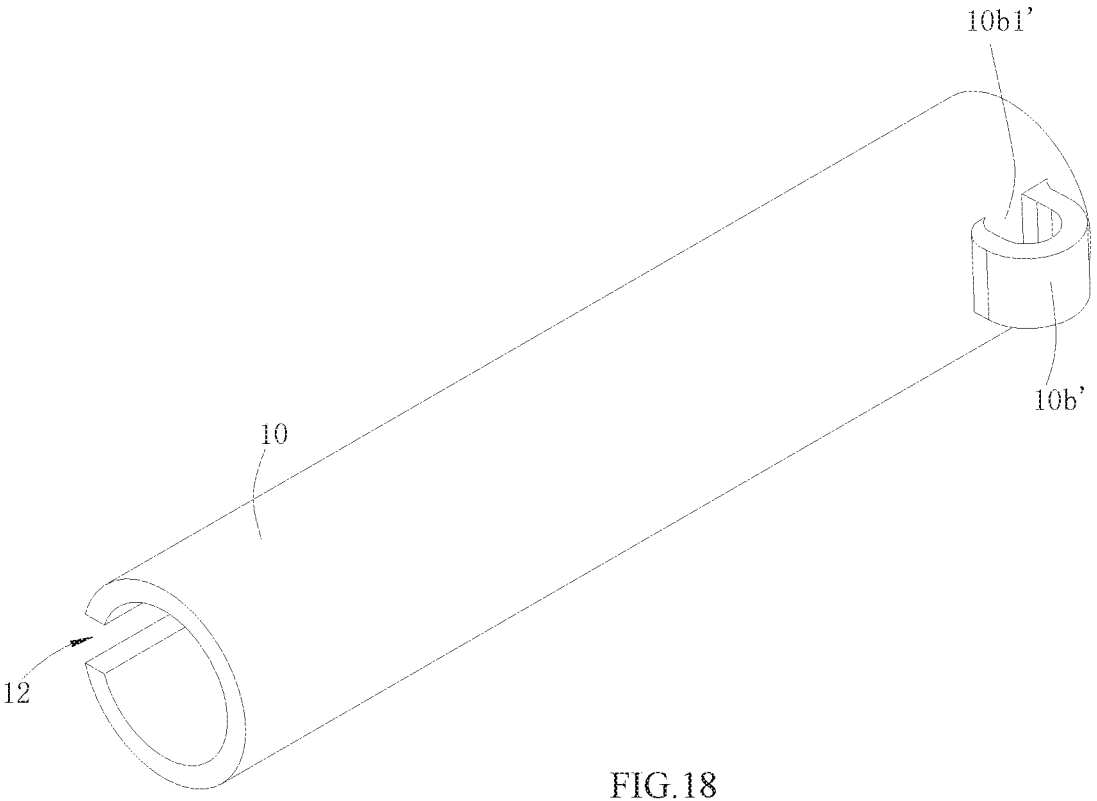
FIG. 18 is a perspective view of another example of a C-shaped buckle of an example of a hair extender of the present disclosure.

In addition, as illustrated in FIG. 18, the C-shaped buckle 10 in this example differs from that in the example as illustrated in FIG. 15 only in that an axis of an inner hole 10*b*1' of a fixing ring 10*b*' is perpendicular to a center line of the C-shaped buckle 10.

The fixing ring 10*b*' is a hook-shaped structure, with one end fixedly connected to an outer wall of the C-shaped buckle 10, and the other end bent towards and clings to the outer wall of the C-shaped buckle 10, so as to form an inner hole 10*b*1' capable of hanging bunched wig upper end connecting strings between the fixing ring 10*b*' and the outer wall of the C-shaped buckle 10.

Figure 19:
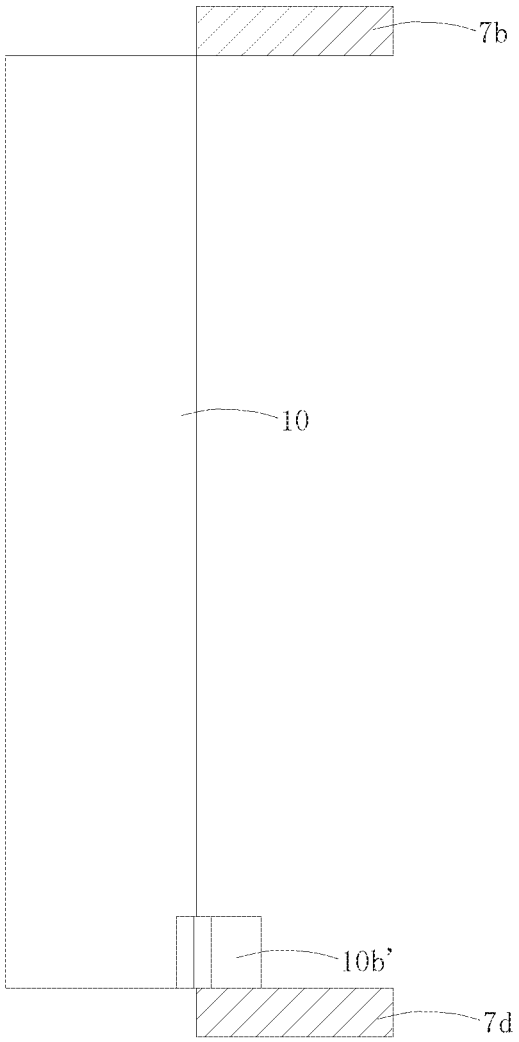
FIG. 19 is a side view of an engagement between a C-shaped buckle and a buckle plate of an example of a hair extender of the present disclosure.

In this example, referring to FIG. 19, the second limiting boss 7*d* at the front side of the buckle plate 7 of the hair extender is abutted below the fixing ring 10*b*', so as to position the C-shaped buckle 10, and prevent the C-shaped buckle 10 from moving downwards and going away from the clamping by the first clamping boss 1*c* and the second clamping boss 2*a*.

In the present disclosure, the number of the first clamping bosses 1*c*, the second clamping bosses 2*a*, the first limiting bosses 7*b* or the second limiting bosses 7*d* is not limited to ten, and any other number may also be selected upon the actual operation demand, which is not restricted herein.

The above descriptions just illustrate one embodiment of the present disclosure. It shall be pointed out that many modifications and improvements can be made by a person skilled in the art without deviating from the principle of the present disclosure, and those modifications and improvements shall fall within the protection scope of the present disclosure.

The invention claimed is:

1. A hair extender for attaching hair extensions, comprising:

a main plate comprising:

a proximal end, a distal end, a front surface, a rear surface, a top surface and a bottom surface, where the front surface and rear surface extend from the distal end to the proximal end along a longitudinal direction and are disposed substantially parallel to each other, and the top surface and bottom surface extend from the distal end to the proximal end along the longitudinal direction in a substantially parallel relation to each other while being transverse to the front and rear surfaces, a sliding groove provided on the rear surface of the main plate, the sliding groove extending from the distal end to the proximal end along the longitudinal direction, where the sliding groove has a fixture block provided at the proximal end of the sliding groove, a plurality of first clamping bosses projecting from the sliding groove in a direction towards the front surface such that terminal ends of the first clamping bosses extend beyond the front surface, wherein the plurality of first clamping bosses are distributed at an interval and in a straight line along the sliding groove, each of the first clamping bosses of the plurality of first clamping bosses comprises a first clamping recess provided on a right sidewall of each of the first clamping bosses;

a plurality of mounting grooves provided along the sliding groove and extending from the back surface through the main plate to the front surface, wherein each one of the mounting grooves corresponds to and is provided adjacent to one of the first clamping bosses, a moving groove extending transversely through the top surface and bottom surface;

a clamping assembly mounted in the sliding groove of the main plate, the clamping assembly comprising:

a push rod extending within the sliding groove along the longitudinal direction, a reset spring provided between a proximal end of the push rod and the fixture block such that a proximal end of the reset spring abuts the fixture block and the distal end of the reset spring abuts a proximal end of the push rod, a plurality of second clamping bosses projecting from the push rod and extending towards the front surface such that terminal ends of the second clamping bosses extend beyond the front surface, each of the second clamping bosses having a second clamping recess on a left sidewall thereof and each of the plurality of second clamping bosses extends through a corresponding one of the mounting grooves of the main plate such that the left sidewall of each of the second clamping bosses is disposed immediately adjacent to a right sidewall of a corresponding one of the first clamping bosses to define pairs of first and second clamping bosses, where each pair of first and second clamping bosses provide a clamping cavity defined by the first and second clamping recesses and each clamping cavity is configured to receive a hair extension clip; and a transmission pressing plate comprising:

a proximal portion slidably disposed within the moving groove of the main plate such that the transmission pressing plate slides vertically, an extension portion extending longitudinally from the proximal portion toward the distal end of the main plate, where the extension portion is disposed above the plurality of first and second clamping bosses, a plurality of vertical mounting rods provided on a bottom surface of the extension portion, each one of the plurality of vertical mounting rods are disposed directly above a corresponding one of the clamping cavities; and an actuating element operatively connected to the clamping assembly and the transmission pressing plate;

wherein during use, hair extension clips and a user's natural hair are disposed in the clamping cavities and upon actuation of the actuating element, the vertical mounting rods on the extension portion slide downwardly into the clamping cavities and the clamping assembly slides along the sliding groove toward the distal end of the main plate such that each of the plurality of second clamping bosses slide toward their corresponding plurality of first clamping bosses to clamp hair extension clips to a user's natural hair.

2. The hair extender according to claim 1, further comprising a buckle plate, the buckle plate comprising:

a front buckle surface and a rear buckle surface where the rear buckle surface is fixed to the front surface of the main plate, a through-hole extending from the rear buckle surface to the front buckle surface, the through-hole configured to receive the plurality of first clamping bosses and the plurality of second clamping bosses through the through-hole such that the plurality of first clamping bosses and the plurality of second clamping bosses project through the through-hole and past the first buckle surface;

a plurality of first limiting bosses projecting from the front buckle surface, the plurality of first limiting bosses located above the through-hole, each of the first limiting bosses having a first limiting recess on the right sidewall thereof, each of the first limiting recesses is disposed above and longitudinally offset from a corresponding one of the first clamping recesses such that each first limiting recess is closer to the proximal end than the corresponding one of the first clamping recesses;

a plurality of second limiting bosses projecting from the front buckle surface, the plurality of first limiting bosses located below the through-hole, each of the second limiting bosses having a second limiting recess on the right sidewall thereof, each of the second limiting recesses is disposed below and longitudinally offset from a corresponding one of the first clamping recesses such that each first limiting recess is closer to the proximal end than the corresponding one of the first clamping recesses.

3. The hair extender according to claim 2, wherein each of the first clamping bosses of the plurality of first clamping bosses comprising a chamfer between the right sidewall and the terminal end thereof;

each of the second clamping bosses of the plurality of second clamping bosses comprising a chamfer between the left sidewall and the terminal end thereof;

each of the first limiting bosses of the plurality of first limiting bosses comprising a chamfer between the right sidewall and the terminal end thereof and;

each of the second limiting bosses of the plurality of second limiting bosses comprising a chamfer between the right sidewall and the terminal end thereof.

4. The hair extender according to claim 1, further comprising a handle, connected to the main plate and the transmission pressing plate, where a middle portion of the handle is hinged with a bottom surface of the main plate, and an end of the handle is hinged with a bottom surface of the transmission pressing plate.

5. The hair extender according to claim 1, further comprising a hair fixing assembly, the main plate further comprising a fixed sliding groove, a fixed sliding groove defined by an aperture in a distal-most wall of the main plate, a recess in a middle wall of the main plate and a longitudinal space therebetween, where the middle wall of the main plate is disposed between the proximal and distal ends of the main plate, proximate to the moving groove and the middle wall is oriented transversely with respect to the top, bottom, front and rear surfaces of the main plate where the longitudinal space is provided above the plurality of first clamping bosses, and the fixed sliding groove is in communication with the moving groove;

the transmission pressing plate further comprising a sliding block, the sliding block provided on a rear surface thereof, the sliding block further comprising a proximal block sidewall, a distal block sidewall, a top block surface, and a bottom block surface, the distance between the proximal block sidewall and distal block sidewall increases from the bottom block surface to the top block surface;

the hair fixing assembly is mounted in the fixed sliding groove of the main plate, the hair fixing assembly comprising:

a shaft lever, a first fixing block fixed at a distal end of the shaft lever, a second fixing block fixed at a proximal end of the shaft lever, a moving block movably disposed on the shaft lever between the first and second fixing blocks, and a hair fixing spring disposed on the shaft lever between the first fixing block and the moving block;

the moving block and the second fixing block each comprising a displacement bulge, the displacement bulge of each the moving block and the second fixing block projecting into the moving groove of the main plate and in contact with the proximal block sidewall and distal block sidewall such that the displacement bulge of the second fixing block contacts the proximal block sidewall and the displacement bulge of the moving block contacts the distal block sidewall of the sliding block;

wherein during use, the sliding block of the transmission pressing plate slides downward relative to the hair fixing assembly such that the distance between the second fixing block and the moving block increases, thereby compressing the hair fixing spring in order to fix or clamp a user's hair.

6. The hair extender according to claim 5, wherein, the sliding groove of the main plate communicates with the moving groove;

a rear surface of the sliding block of the transmission pressing plate is provided with a elongated hole having a lengthwise direction parallel to the distal block sidewall;

the push rod further comprising:

a counter bore extending through a front surface of the push rod where the counter bore is aligned with the elongated hole of the transmission pressing plate;

a reutilization assembly comprising:

a reutilization spring and a connection rod inserted through the counter bore of the push rod and the elongated hole of the transmission pressing plate; a front end and a rear end of the connection rod are each provided with a convex ring, the reutilization spring is mounted over the connection rod, a front end of the reutilization spring abuts against a rear end surface of the push rod, and a rear end of the reutilization spring abuts against the convex ring at a rear end of the connection rod.

* * * * *